US011622179B2

(12) United States Patent
Christie

(10) Patent No.: US 11,622,179 B2
(45) Date of Patent: Apr. 4, 2023

(54) DEVICE MOUNTING SYSTEM

(71) Applicant: Savant Systems, Inc., Hyannis, MA (US)

(72) Inventor: Cary L. Christie, Gardnerville, NV (US)

(73) Assignee: Savant Systems, Inc., Hyannis, MA (US)

( * ) Notice: Subject to any disclaimer, the term of this patent is extended or adjusted under 35 U.S.C. 154(b) by 1109 days.

(21) Appl. No.: 16/254,245

(22) Filed: Jan. 22, 2019

(65) Prior Publication Data

US 2019/0230424 A1 Jul. 25, 2019

Related U.S. Application Data

(60) Provisional application No. 62/620,264, filed on Jan. 22, 2018.

(51) Int. Cl.
*H04R 1/02* (2006.01)
*H04R 9/02* (2006.01)
(Continued)

(52) U.S. Cl.
CPC ..... *H04R 1/026* (2013.01); *F21S 8/026* (2013.01); *F21V 21/044* (2013.01); *H04R 1/021* (2013.01);
(Continued)

(58) Field of Classification Search
CPC ..... H04R 1/026; H04R 1/021; H04R 1/025; H04R 1/028; H04R 9/025;
(Continued)

(56) References Cited

U.S. PATENT DOCUMENTS 4,459,648 A 7/1984 Ullman
4,673,149 A 6/1987 Grote et al.
(Continued)

FOREIGN PATENT DOCUMENTS

CA 2646034 A1 8/2009
CN 1575033 A 2/2005
(Continued)

OTHER PUBLICATIONS

"Invitation to Pay Additional Fees and Where Applicable Protest Fee," International Filing Date: Jan. 22, 2019, International Application No. PCT/US2019/014534, Applicant: Savant Systems, LLC, dated Apr. 25, 2019, pp. 1-17.
(Continued)

*Primary Examiner* — Sean H Nguyen
(74) *Attorney, Agent, or Firm* — Cesari and McKenna, LLP; James A. Blanchette

(57) ABSTRACT

In one example embodiment, a device mounting system is provided for in-wall and/or in-ceiling use in residential and commercial structures, suitable for both retro-fit and new construction applications. The system includes a mounting ring and a device can. The mounting ring is installed directly into a hole cut at a selected location in the wall or ceiling or into a pre-construction bracket arranged in the wall or ceiling. The device can is later inserted into the mounting ring and retained therein by a combination of a number of magnets that are attracted to a mounting ring flange and a number of spring clips that engage an inner face of a mounting ring body.

18 Claims, 15 Drawing Sheets

(51) Int. Cl.
*F21S 8/02* (2006.01)
*F21V 21/04* (2006.01)
*F21V 21/096* (2006.01)

(52) U.S. Cl.
CPC ..... *H04R 1/025* (2013.01); *H04R 1/028* (2013.01); *H04R 9/025* (2013.01); *F21V 21/096* (2013.01); *H04R 2201/021* (2013.01); *H04R 2201/028* (2013.01)

(58) Field of Classification Search
CPC ..... H04R 2201/021; H04R 2201/028; F21S 8/026; F21V 21/044; F21V 21/096
USPC ..... 181/150
See application file for complete search history.

(56) References Cited

U.S. PATENT DOCUMENTS

| | | | |
|---|---|---|---|
| 4,733,339 | A | 3/1988 | Kelsall |
| 5,206,464 | A | 4/1993 | Lamm et al. |
| 5,388,795 | A | 2/1995 | Struthers et al. |
| 6,870,943 | B2 | 3/2005 | Liu |
| 7,121,756 | B2 | 10/2006 | Wright et al. |
| 7,401,681 | B2 | 7/2008 | Iwayama et al. |
| 7,780,135 | B2 | 8/2010 | Nelson et al. |
| 8,023,664 | B2 | 9/2011 | Yang |
| 8,308,322 | B2 | 11/2012 | Santiago et al. |
| 8,422,722 | B2 | 4/2013 | Maurer et al. |
| 8,485,487 | B2 | 7/2013 | Cheng |
| 8,490,938 | B2 | 7/2013 | Peng |
| 8,520,876 | B2 | 8/2013 | Chang |
| 8,545,063 | B2 | 10/2013 | Dupuy et al. |
| 8,620,016 | B2 | 12/2013 | Belanger et al. |
| 8,631,897 | B2 | 1/2014 | Stewart, Jr. et al. |
| 9,084,046 | B2 | 7/2015 | Ivey et al. |
| 2004/0047487 | A1 | 3/2004 | Popken et al. |
| 2005/0036646 | A1 | 2/2005 | Garner et al. |
| 2006/0221620 | A1 | 10/2006 | Thomas |
| 2007/0290112 | A1 | 12/2007 | Orth et al. |
| 2008/0078903 | A1 | 4/2008 | Struthers et al. |
| 2013/0016864 | A1* | 1/2013 | Ivey ..... H04R 1/028 381/340 |
| 2013/0251181 | A1 | 9/2013 | Stewart, Jr. et al. |
| 2013/0320004 | A1 | 12/2013 | Kerr, Jr. |
| 2018/0112857 | A1* | 4/2018 | Wronski ..... F21V 21/04 |
| 2018/0372284 | A1* | 12/2018 | Danesh ..... F21V 21/088 |
| 2019/0383451 | A1* | 12/2019 | Robinson ..... F21V 11/08 |

FOREIGN PATENT DOCUMENTS

| | | | |
|---|---|---|---|
| CN | 102691949 | A | 9/2012 |
| DE | 202008018211 | U1 | 3/2012 |
| FR | 2647139 | A1 | 11/1990 |
| GB | 2493167 | A | 1/2013 |
| KR | 20-2010-0001958 | U | 2/2010 |

OTHER PUBLICATIONS

"Notification of Transmittal of the International Search Report and the Written Opinion of the International Searching Authority, or the Declaration," International Filing Date: Jan. 22, 2019, International Application No. PCT/US2019/014534, Applicant: Savant Systems, LLC, dated Jun. 17, 2019, pp. 1-20.

* cited by examiner

DEVICE MOUNTING SYSTEM

RELATED APPLICATIONS

The present application claims the benefit of U.S. Patent Application No. 62/620,264 filed on Jan. 22, 2018 by Cary L. Christie, entitled "Tool-Less Speaker Mounting System", the contents of which are incorporated by reference herein in their entirety.

BACKGROUND

Technical Field

The present disclosure relates generally to installation of devices in residential and commercial structures, and more specifically to an in-wall and in-ceiling device mounting system.

Background Information

In-wall and in-ceiling devices, such as in-wall and in-ceiling speakers, light fixtures, cameras, smoke and/or carbon monoxide detectors, etc. are becoming increasingly popular for residential and commercial applications. Such devices provide a number of benefits in contrast to free-standing and surface-mounted devices, as they do not consume floor space and generally provide an unobtrusive visual appearance. However, there are some shortcomings to existing in-wall and in-ceiling device mounting systems. Among other things, the installation procedure for existing in-wall and in-ceiling devices is typically time consuming and error prone. Such shortcomings are applicable to both retro-fit and new construction applications.

Consider the case of a retro-fit in-wall or in-ceiling speaker installation. In such a case, an installer (e.g., an audio/video (A/V) installer) may cut holes at selected location in existing wall or ceiling surface (e.g., drywall) and fish cables through the wall or ceiling. The installer than connects the cables, and installs the speakers directly into the cut holes. The speakers typically include a number of (e.g., 4) dog-leg mounting assemblies. The assemblies typically consist of a screw that extends through a flange of the speaker and a plastic or metal dog leg attached to the screw. When the screw is tightened, the dog leg swings from a retracted position to an extend position and tightens against the interior face of the wall or ceiling surface (e.g., drywall). Such tightening draws the flange against the exterior face of the wall or ceiling surface (e.g., drywall). Pinching action between the dog leg and flange holds the speaker in place.

However, such a mounting system has a number of shortcomings. The installer is required to utilize tools during the installation, for example, a screw driver or drill/driver to tighten the screws. If the installer over-tightens the screws, they may bend the flange of the speaker, hindering installation of speaker grilles, or damaging the wall or ceiling surface (e.g., drywall) the speaker is being installed into. If the installer under-tightens the screws, the speaker may not be well secured into the wall or ceiling. Should an installer be required to remove a speaker (for example, to change or check cable connections or for other purposes), the process may be finicky. Dog legs may not always swing back out of the way, hindering removal. Further, repeated installation and removal may cause damage to the wall or ceiling surface (e.g., drywall) because the dog legs and flange directly engage with its faces. If this damage extends beyond the portion concealed by the flange (and/or grille or faceplate), it may require patching to avoid an unsightly appearance. To simplify construction workflows, the installer may be tempted to install devices at an earlier stage of a construction project, when they are performing other tasks. Since repeated removal can cause damage to the wall or ceiling surface (e.g., drywall), they may further be tempted to leave the devices in place. Such early installation may render device internals more exposed to damage from dust, debris, impact, moisture, etc. present in ongoing work at the jobsite. These shortcomings are not limited to speakers. Similar issues are confronted with other types of retro-fit in-wall or in-ceiling device installations.

Next, consider the case of a new construction in-wall or in-ceiling speaker installation. An installer may run cabling and attach pre-construction brackets (also referred to a "rough-in brackets) to studs or joists before the wall or ceiling surface (e.g. drywall) is installed. A typical pre-construction bracket includes a mounting frame attached to a pair of mounting wings. The mounting frame is a relatively thin frame that serves as a template to cut the proper size hole for the intended speaker. The mounting wings are thin flanges (typically sheet metal) that extend on opposing sides of the mounting frame to span a joist or stud bay. The mounting wings are nailed or screwed to the joists or studs on either side of the bay to hold the mounting frame in a selected location. After the wall or ceiling surface (e.g., drywall) has been installed, and a hole cut based on the pre-construction bracket. The installer then connects the cables and installs the speaker into the cut hole. The speaker is typically similar to those used in retro-fit applications, and includes dog-leg mounting assemblies. However, in a new construction application, when the screws are tightened, the dog legs swing out and engage against the pre-construction bracket that is disposed on the interior face of the wall or ceiling surface (e.g., drywall), rather than the interior surface of the surface itself.

An installation using a pre-construction bracket still has a number of shortcomings. The installer is still required to use tools to install the speaker within the hole defined by the pre-construction bracket. Even though the dog-leg assemblies may engage the pre-construction bracket rather than the interior face of the wall or ceiling surface (e.g., drywall) itself, there still may be issues with over-tightening or under-tightening of screws, difficulties of removal, and potential damage to the surface. Again, these shortcomings are not limited to speakers. Similar issues are confronted with other types of new construction in-wall or in-ceiling device installations.

Accordingly, there is a need for a new in-wall and in-ceiling device mounting system that can address some or all of these shortcomings. It would be desirable if such a device mounting system were applicable to a wide range of devices, such as speakers, light fixtures, cameras, smoke and/or carbon monoxide detectors, etc., and were applicable to both retro-fit and new construction applications.

SUMMARY

In one example embodiment, a device mounting system is provided for in-wall and/or in-ceiling use in residential and commercial structures, suitable for both retro-fit and new construction applications. The system includes a mounting ring that assists in mounting the device, and a device can (e.g., a speaker can, a light can, a camera can, a smoke and/or carbon monoxide detector can, etc.) that the includes device internals (e.g., an active or passive speaker, light fixture such as a flood, spot or wall washer, camera, smoke and/or carbon monoxide detector, etc.).

In an example installation, an installer installs the mounting ring at a first time, often at a relatively early stage of the project. In the case of a retro-fit, the mounting ring is installed into a hole cut at a selected location in an existing wall or ceiling surface (e.g., existing drywall). The mounting ring is retained by a mounting ring flange (e.g., made of a ferromagnetic metal such as steel) that engages the exterior face of the wall or ceiling (e.g., the exterior face of the drywall), and a number of (e.g., 4) spring clips affixed to the mounting ring body that engage the interior surface of wall or ceiling (e.g., the interior surface of the drywall). Pinching action created by the spring clips holds the mounting ring in place.

In the case of a new construction application, a pre-construction bracket, that includes a pre-construction bracket body and wings, is installed prior to the wall or ceiling surface (e.g., the drywall) being added installed. The pre-construction bracket is retained by attachment of the wings by fasteners (e.g., nails) to studs or joists. The pre-construction bracket may be used as a guide to cut a hole in the surface (e.g., cut the drywall) of the wall or ceiling, or, for a flush-mount installation, may be used with a mud housing and mud ring to which plaster or compound may be applied, thereby defining the hole. A mounting ring is installed into the hole defined by the pre-construction bracket and is retained similar to as in a retro-fit application by a number of (e.g., 4) spring clips.

Typically, the device can is installed at a second time, at a relatively late stage of the project. The device can is inserted into the mounting ring and retained therein by a combination of a number of (e.g., 4) magnets that are attracted to the mounting ring flange and a number of (e.g., 4) additional spring clips that engage an inner surface of the mounting ring body. In some cases, a grille or faceplate may and applied once the device can is in place, to provide a finished appearance.

Such a device mounting system may have a number of advantages. The installation of the mounting ring into the hole in the wall or ceiling surface (e.g., drywall) or pre-construction bracket, and the installation of the device can into the mounting ring, may be tool-less (i.e. may not require use of a screw-driver, drill/driver, hammer or other hand or power tools). Accordingly, issues of over tightening or under-tightening screws, and potential damage or lack of secure mounting caused thereby, may be avoided. Further, the entire device can (which holds the device internals) may be easily, and even repeatedly, removed from the wall or ceiling, without damage to the surface of the wall or ceiling (e.g., without damage to the drywall). Still further, work tasks may be performed at more optimal times in a project workflow. For example, installation of device can (which holds the device internals) may be reserved to a late stage of the project. This may minimize the risk of damage from dust, debris, impact, moisture, etc. to potentially sensitive device internals.

It should be understood that a variety of additional features and alternative embodiments may be implemented other than those discussed in this Summary. This Summary is intended simply as a brief introduction to the reader, and does not indicate or imply that the examples mentioned herein cover all aspects of the disclosure, or are necessary or essential aspects of the disclosure.

BRIEF DESCRIPTION OF THE DRAWINGS

The description below refers to the accompanying drawings of example embodiments, of which.

DETAILED DESCRIPTION

Figure 1:
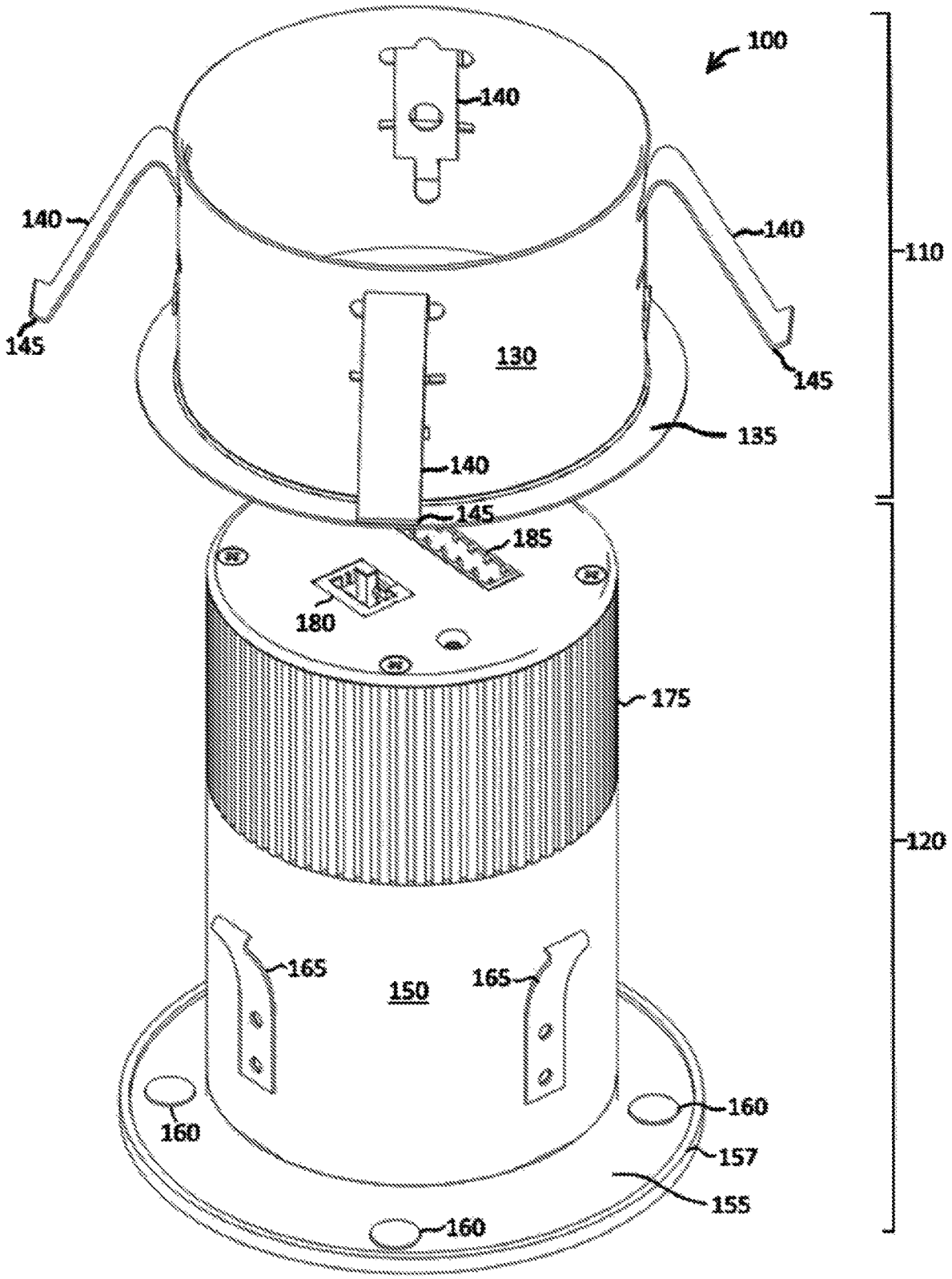
FIG. 1 is a perspective view depicting an example device mounting system in an embodiment where the device is an active speaker.
Figure 2:
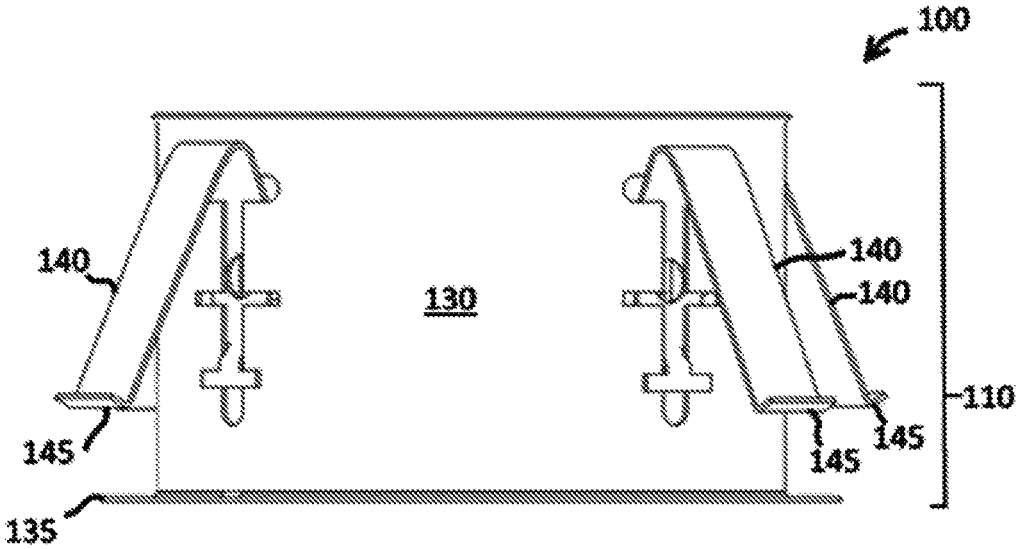
FIG. 2 is a front view depicting the example device mounting system of FIG. 1.
Figure 2:
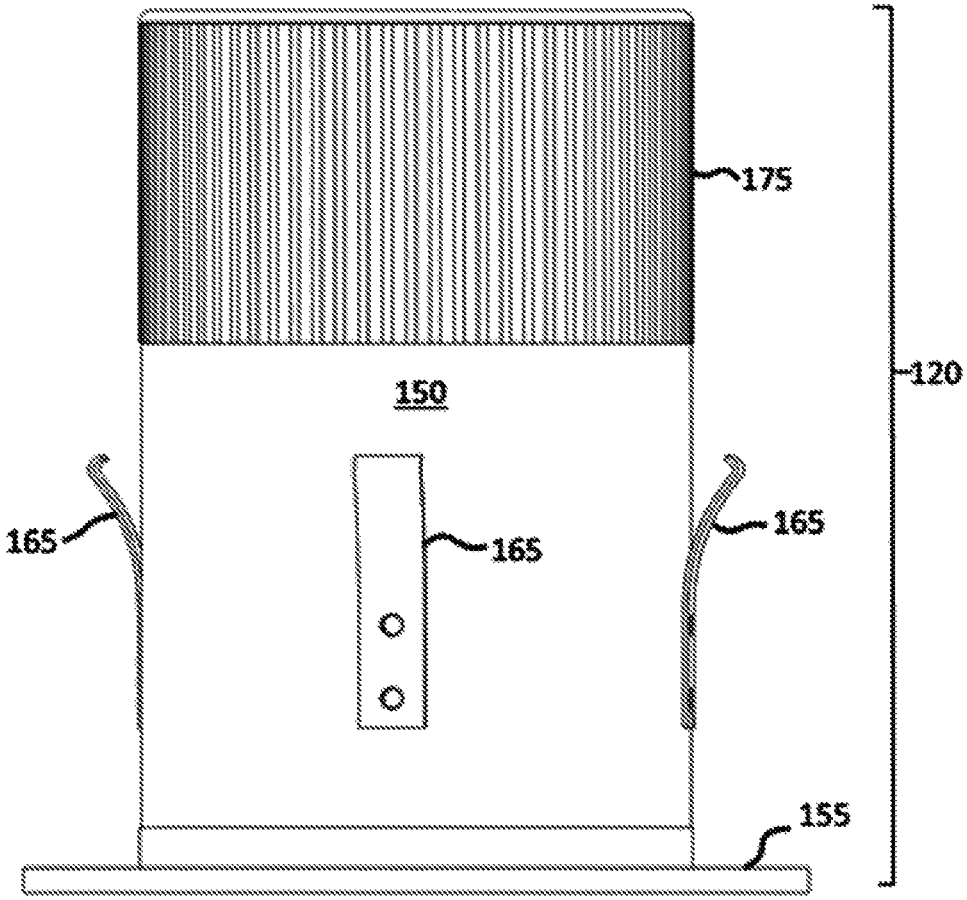
Figure 3:
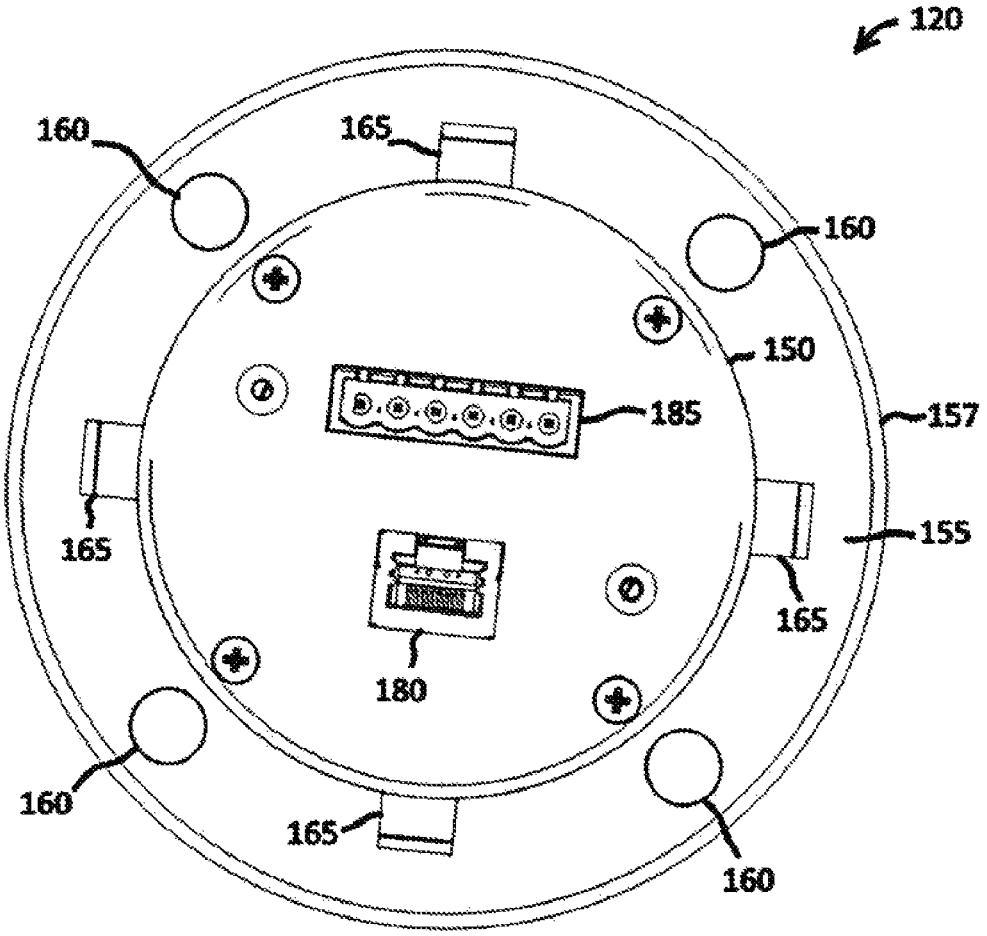
FIG. 3 is a top view of a device can of the example device mounting system of FIG. 1.
Figure 4:
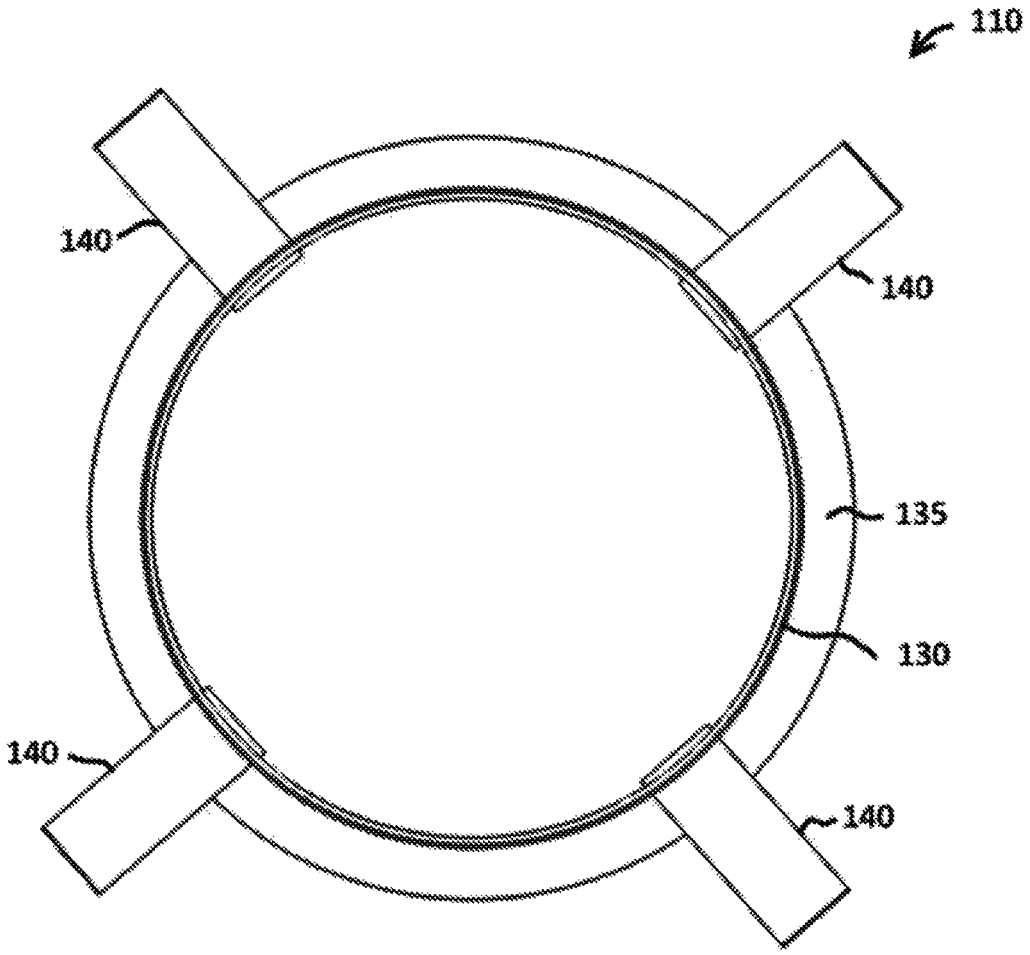
FIG. 4 is a top view of a mounting ring of the example device mounting system of FIG. 1.
Figure 5:
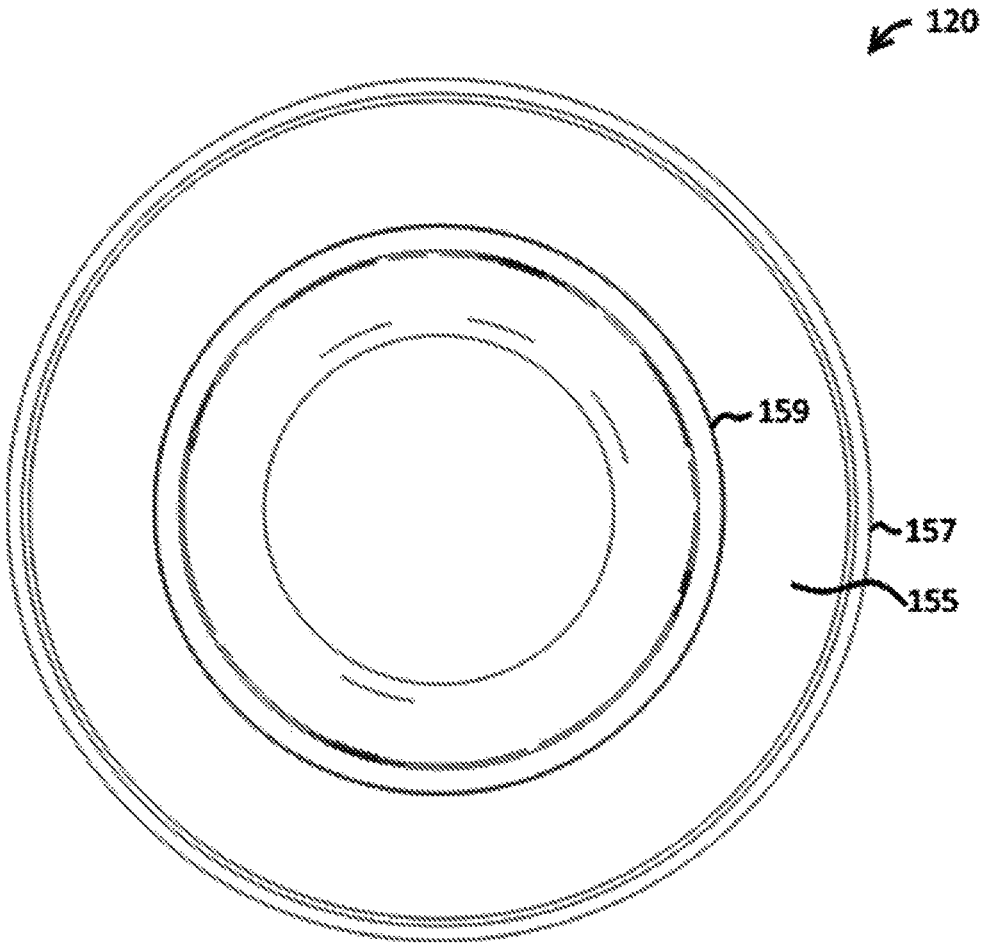
FIG. 5 is a bottom view of the device can of the example device mounting system of FIG. 1.
Figure 6:
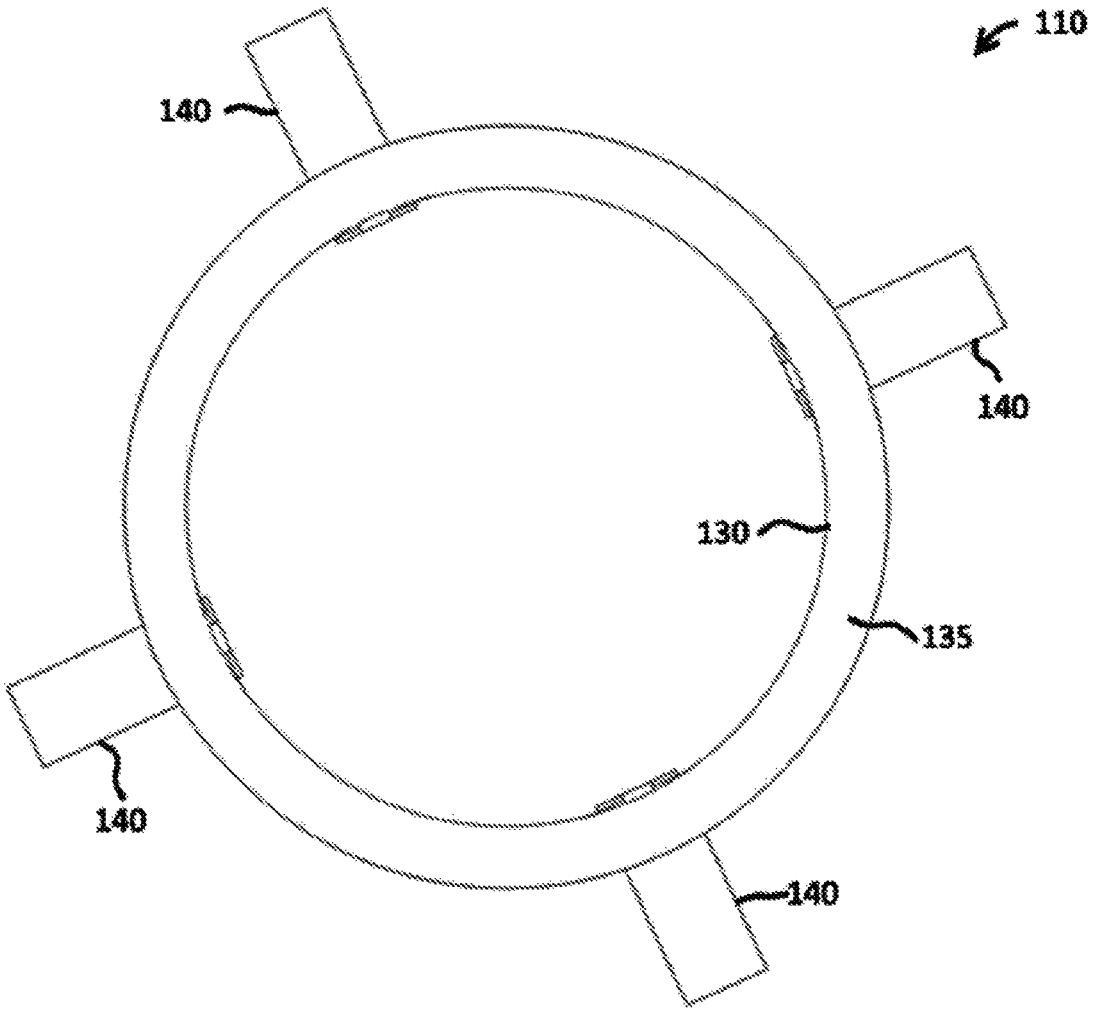
FIG. 6 is a bottom view of the mounting ring of the example device mounting system of FIG. 1.

Referring to FIGS. 1-6, an example device mounting system 100 is shown for an embodiment where the device is an active speaker. The system 100 includes a mounting ring 110 and a device can (e.g., speaker can) 120. The mounting ring 110 includes a substantially cylindrical mounting ring body 130 that defines a hollow cavity and a mounting ring flange 135 that extends radially therefrom, at its bottom end. The mounting ring body 130 and mounting ring flange 135 may be integrally formed from a piece of ferromagnetic metal (e.g., steel). Alternatively, the mounting ring body 130 and mounting ring flange 135 may be separate components that are joined together. In such cases, just the mounting ring flange 135 may be made from a ferromagnetic metal (e.g., steel) and the body may be made from another material. A number of (e.g., 4) spring clips 140 are affixed to an exterior surface of the mounting ring body 130. The spring clips may be slidably-affixed to the mounting ring body 130 by a slotted-connection where an inner portion of the spring clips 140 are woven through slots formed in the mounting ring body 130. The slotted-connection may allow for the spring clips 140 to have vertical travel through a range of motion, to facilitate easier installation and to accommodate different thicknesses of a wall or ceiling surface (e.g., different thicknesses of drywall) and pre-construction brackets when installed. Alternatively, the spring clips 140 may be rigidly affixed to the mounting ring body 130, for example, using fasteners (e.g., rivets, screws, etc.). An outer portion of the spring clip 140 may include a back-bent portion 145. The spring clips 140 may be made from a material that returns to its original shape after significant deflection, such as spring steel.

In a typical installation, an installer installs the mounting ring 110 at a first time (often at a relatively early stage of the project). In a retro-fit application, the mounting ring 110 may installed when cabling is being fished, but new components (e.g., A/V components) are not yet installed. The installer cuts a hole at a selected location in a wall or ceiling surface (e.g., in the drywall) having a diameter slightly larger than the cross section of the mounting ring body 130. The hole may be cut freehand or with the aid of a template or other guide. The mounting ring body 130 is then inserted therein. During insertion, the spring clips 140 are pressed back against the mounting ring body 130, but then spring back once within the wall or ceiling cavity. The mounting ring 110 is pressed snugly into the wall or ceiling, such that the spring clips 140 slide through their range of motion, so that the back-bent portions 145 engage the interior face of the wall or ceiling surface (e.g., the interior face of the drywall). The mounting ring flange 135 engages the exterior face of the wall or ceiling surface (e.g., the exterior face of the drywall). Pinching action created by the spring clips 140 holds the mounting ring 110 in place.

Figure 12:
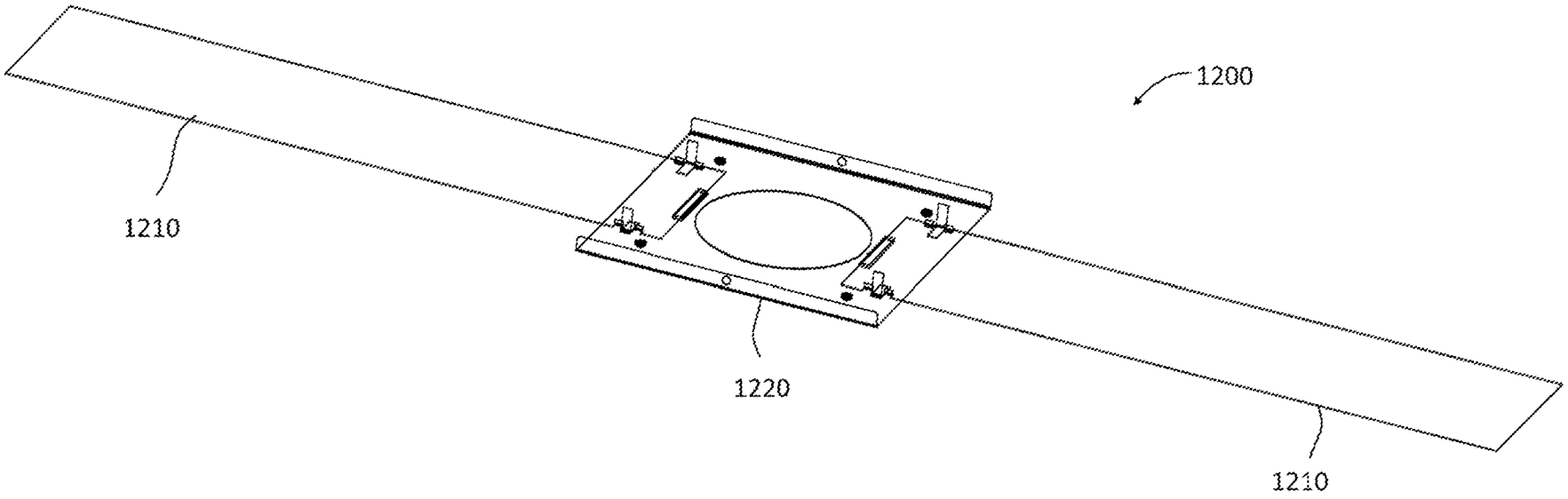
FIG. 12 is a perspective view depicting an example pre-construction bracket that may be used with an example device mounting system.
Figure 13:
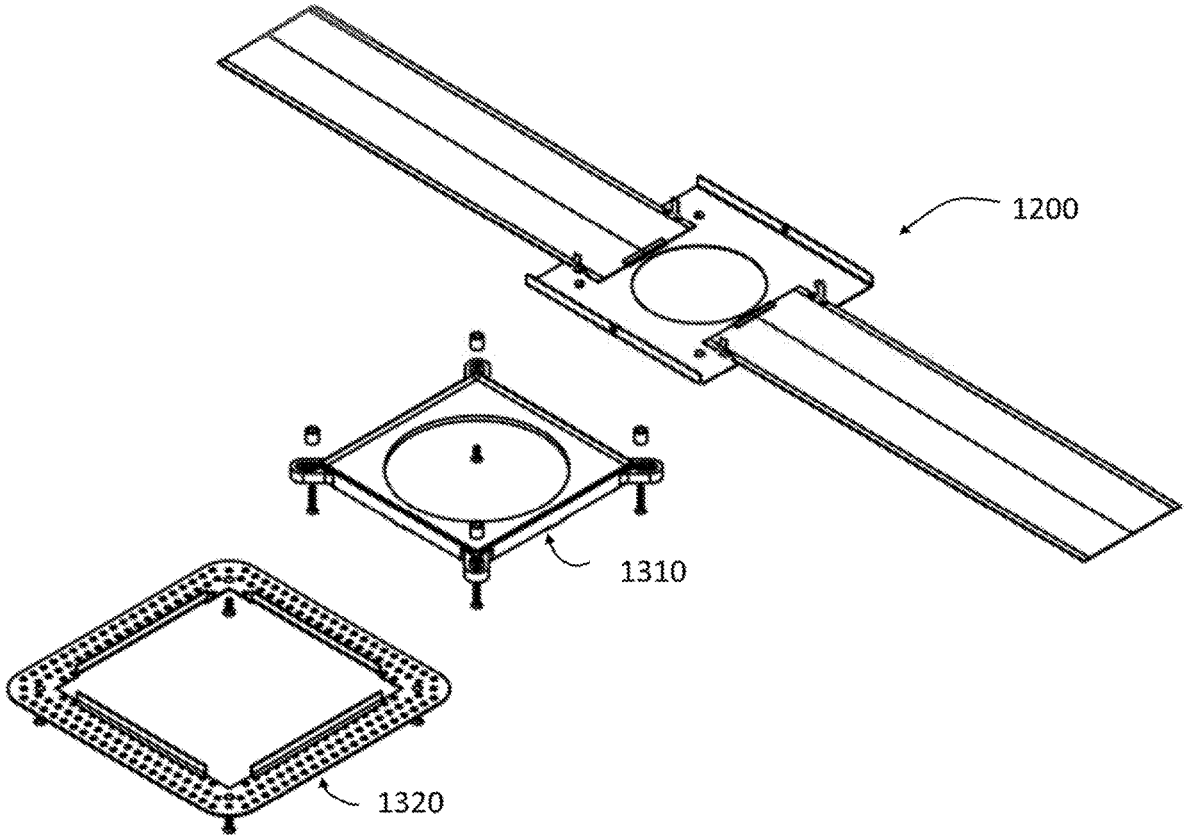
FIG. 13 is a perspective view depicting an example mud housing and mud ring that may be attached to an example pre-construction bracket to enable a flush-mount installation.

In a new-construction application, the mounting ring 110 may installed after a pre-construction brackets 1200, cabling and wall and ceiling surfaces (e.g., drywall) have been installed, but sill prior to completion of construction at the jobsite. Referring to FIG. 12, the pre-construction bracket 1200 includes a pre-construction bracket body 1220 and wings 1210. The pre-construction bracket 1220 it retained by attachment of the wings 1210 by fasteners (e.g., nails) to studs or joists prior to the surface (e.g., the drywall) being added to the wall or ceiling. In some installations, the pre-construction bracket 1200 may be used as a guide to cut a hole in the surface (e.g., the drywall) of the wall. After the surface (e.g. drywall) is in place, the mounting ring 110 is inserted into a hole defined by the pre-construction bracket. In a flush-mount installation, the pre-construction bracket may be used in combination with a mud housing 1310 and a mesh mud ring 1320. The mud housing 1310 may be attached to the preconstruction bracket prior to installation of the wall or ceiling surface (e.g., drywall), and the surface (e.g., drywall) installed up to the housing. The mud ring 1320 may be attached thereto, and plaster or compound applied.

The mounting ring 110 is installed in the pre-construction bracket 1200 similar to installation directly into the wall or ceiling surface (e.g. drywall). The mounting ring is inserted into the hole defined by the pre-construction bracket 1200 and during insertion, the spring clips 140 are pressed back against the mounting ring body 130, but then spring back once within the hole. The mounting ring 100 is pressed snugly into the hole, such that the spring clips 140 slide through their range of motion, so that the back-bent portions 145 engage the interior face pre-construction bracket. In a typical installation, the mounting ring flange 135 engages the exterior face of the wall or ceiling surface (e.g., the exterior face of the drywall). In a flush-mount installation, the mounting ring flange 135 may engage the mud housing. Pinching action created by the spring clips 140 holds the mounting ring 110 in place.

The device can 120 includes a substantially cylindrical device can body 150 sized with a diameter slightly smaller than the mounting ring body 130, and a device can flange 155 that extends radially from the device can body 150, at its bottom end. The device can body 150 and device can flange 155 may be integrally formed, or may be separate components that are joined together. A number of (e.g., 4) magnets 160 are disposed in the device can flange 155. The magnets 160 may be disposed in holes that extend through the device can flange 155 from its top surface to its bottom surface. Alternatively, the magnets 160 may be disposed in depressions or upon the surface. The magnets 160 may be retained in place by a pressure fit, adhesive or other form of ridged attachment. The device can flange 155 may have a raised lip 157, having a diameter slightly larger than the mounting ring flange 135. The raised lip 157 may be raised on both the upper side and the lower side of the device can flange 155.

Figure 7:
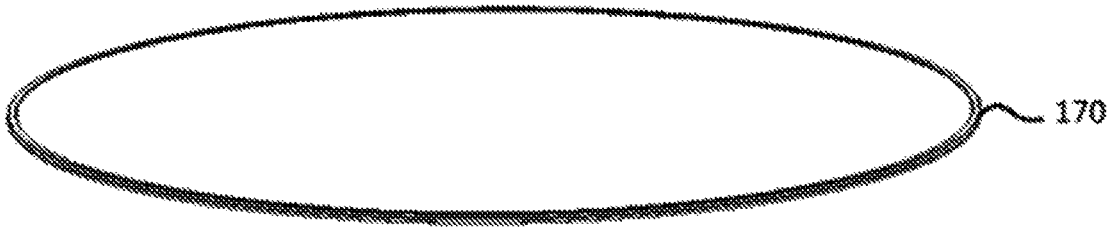
FIG. 7 is an example grille that may cover the bottom of the device can in an embodiment where the device is a speaker.

Referring to FIG. 7, for an embodiment where the device is a speaker such as the active speaker shown in FIGS. 1-6, a grille or faceplate 170 may be provided. The grille or faceplate 170 may have a diameter slightly smaller than raised lip 157, such that when affixed to the device can flange 155, it fits within the lip 157. The grille 170 may be made of a fabric material stretched over a frame. A number of pieces of ferromagnetic metal (steel) may be disposed in the frame at locations coinciding with the magnets 160.

A number of (e.g., 4) additional spring clips 165 may be affixed to the device can body 150 and extend outward therefrom. The additional spring clips 165 may be affixed to the device can body 150 using fasteners (e.g., rivets, screws, etc.) or other ridged form of connection, and may be made from a material that returns to its original shape after significant deflection (e.g., spring steel).

Figure 8:
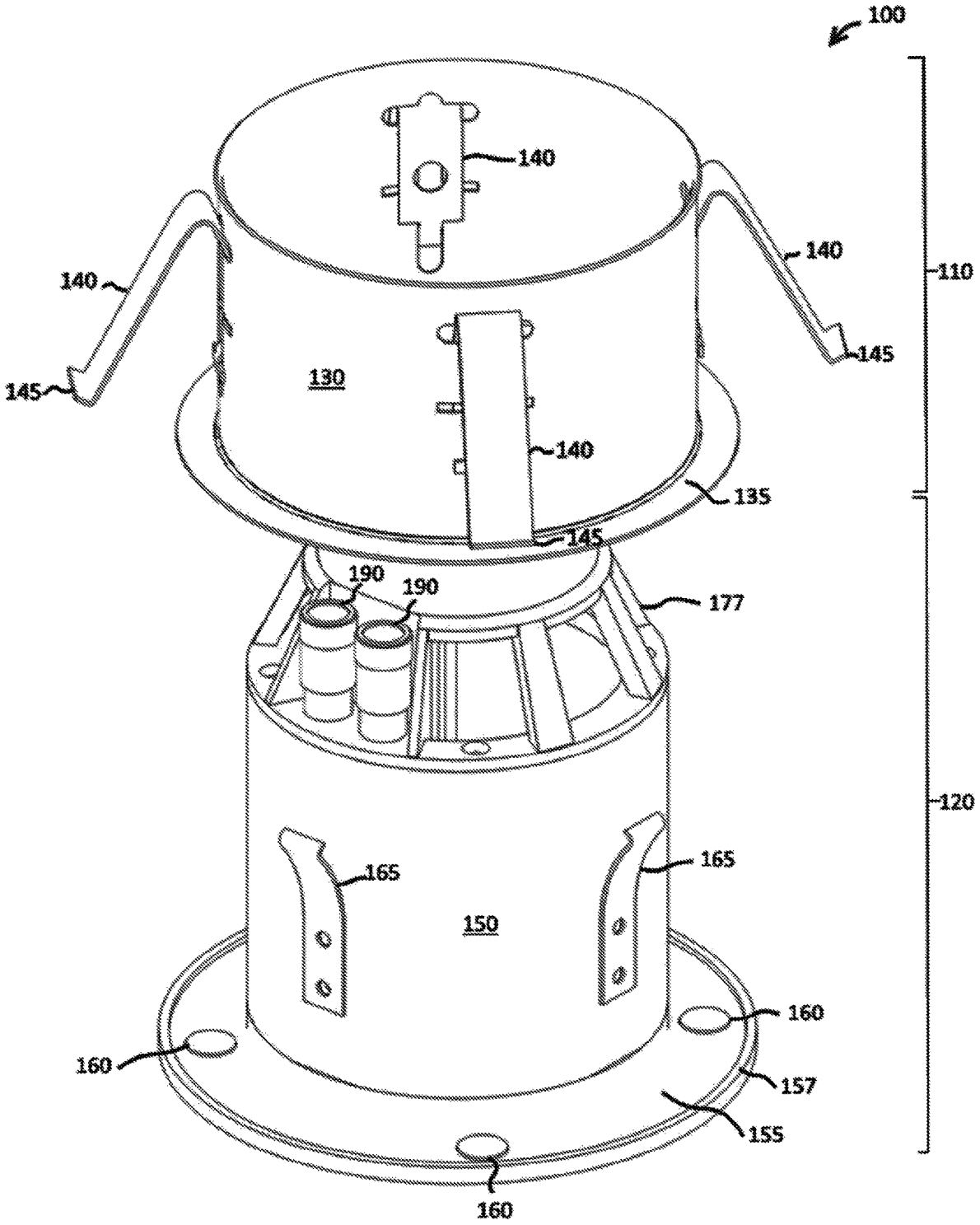
FIG. 8 is a perspective view depicting an example device mounting system employed in an embodiment where the device is a passive speaker.
Figure 9A:
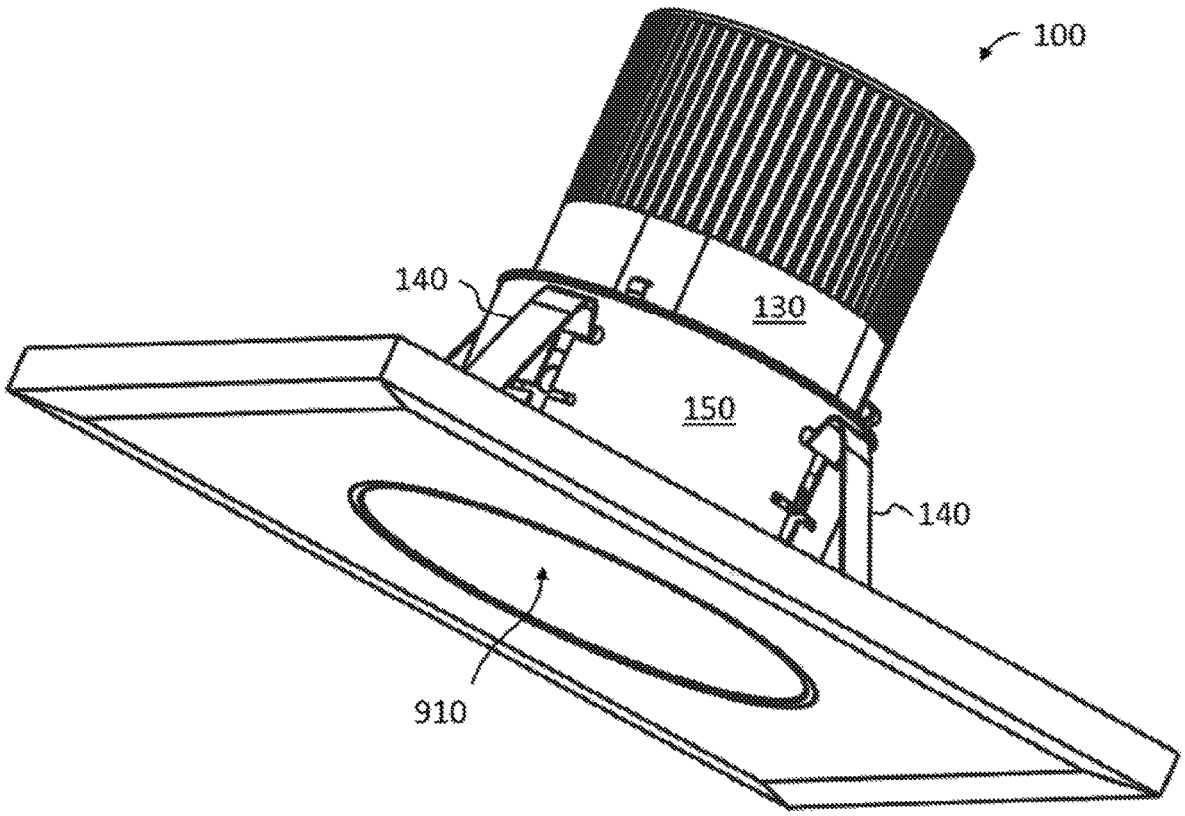
FIGS. 9*a*-9*c* are perspective views depicting an example mounting system employed in embodiments where the device is a light fixture, specifically a flood (9*a*), spot (9*b*) or wall washer (9*c*)
Figure 9B:
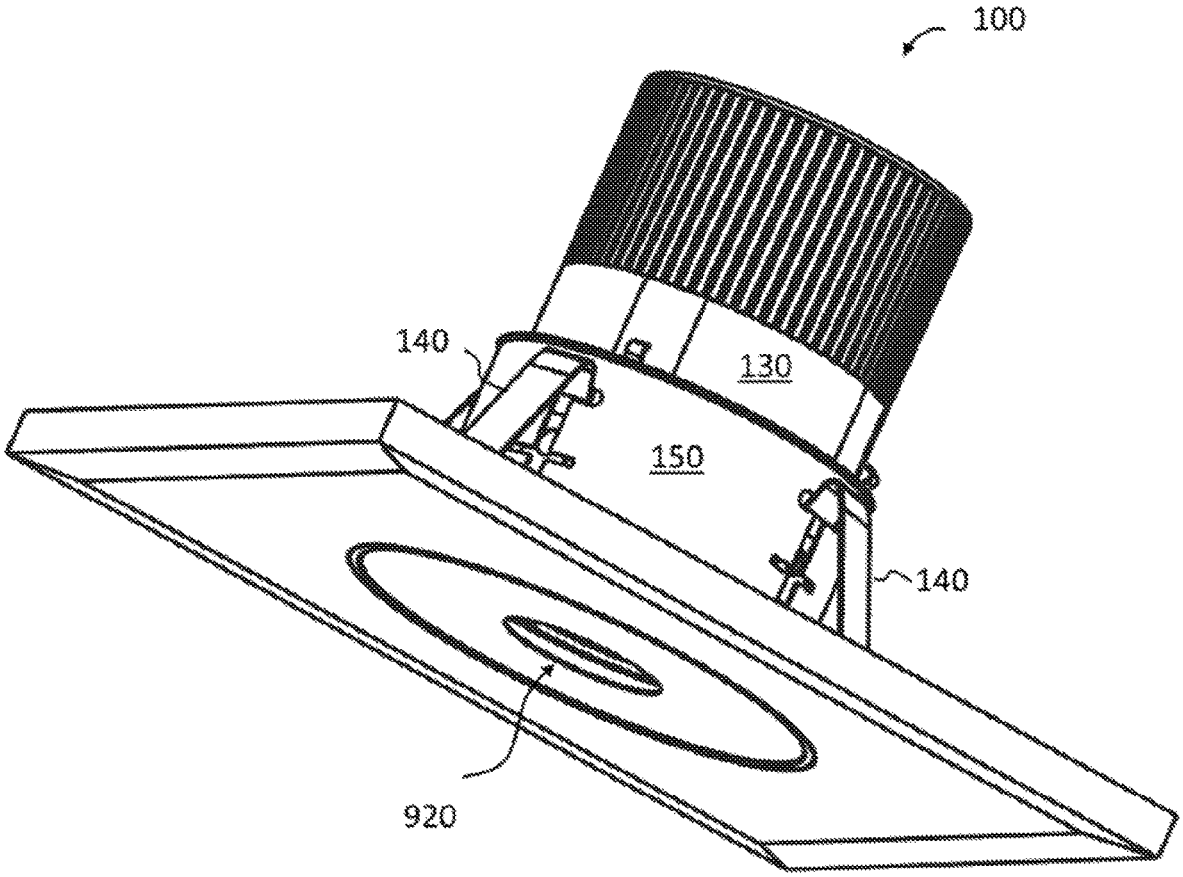
Figure 9C:
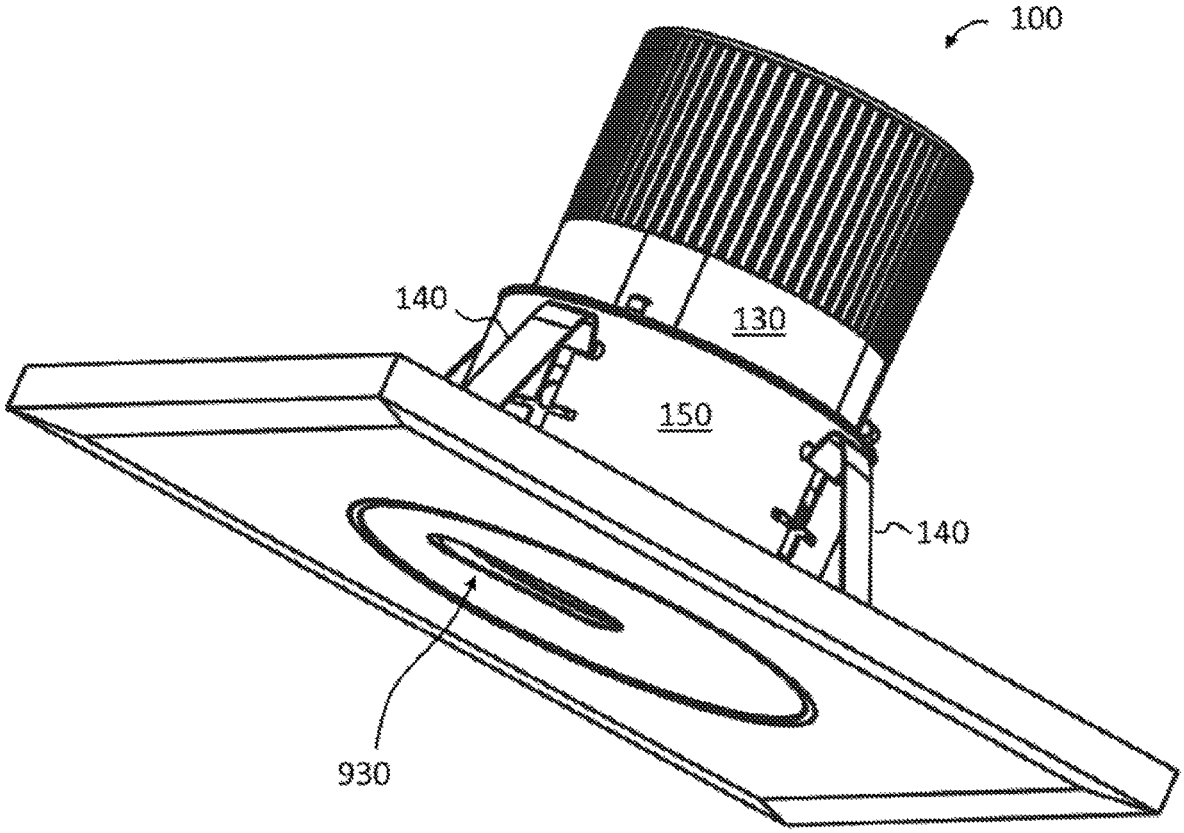
Figure 10:
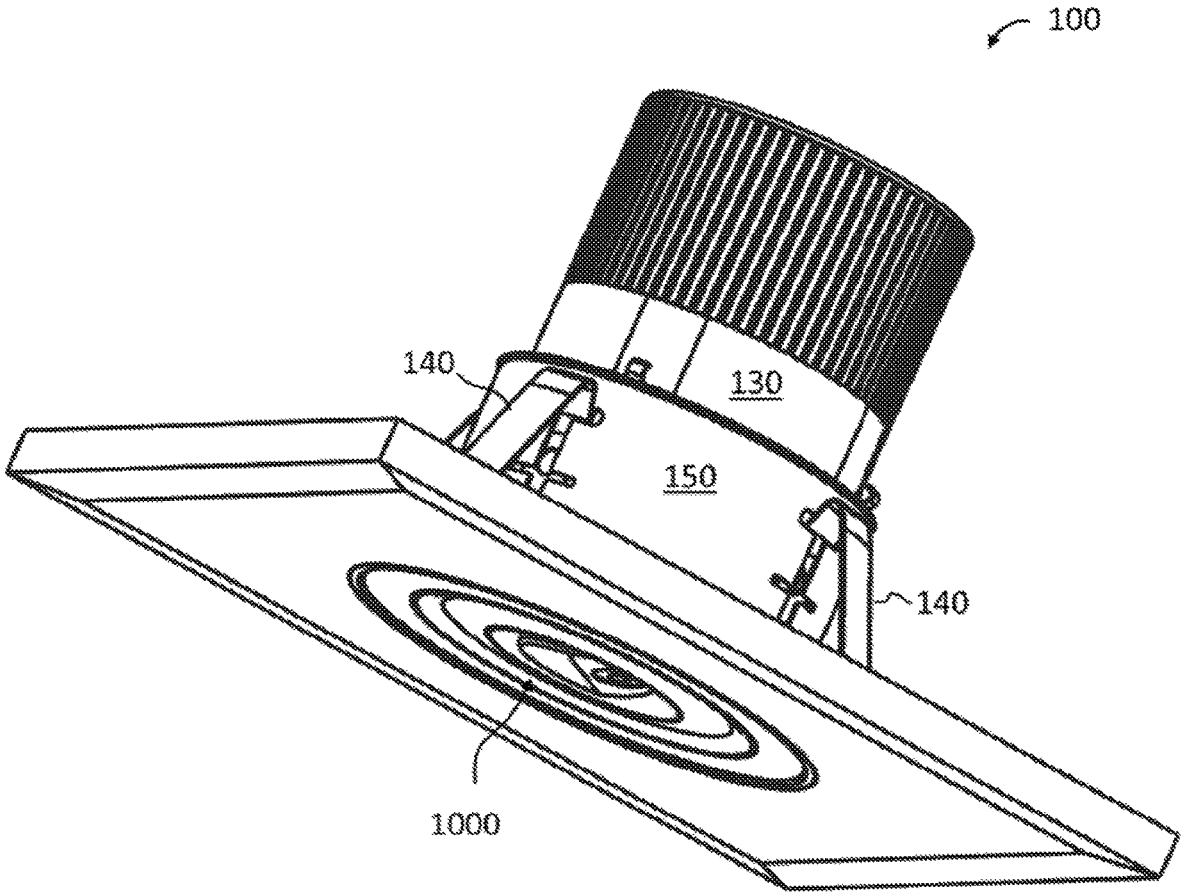
FIG. 10 is a perspective view depicting an example device mounting system employed in an embodiment where the device is a camera.
Figure 11:
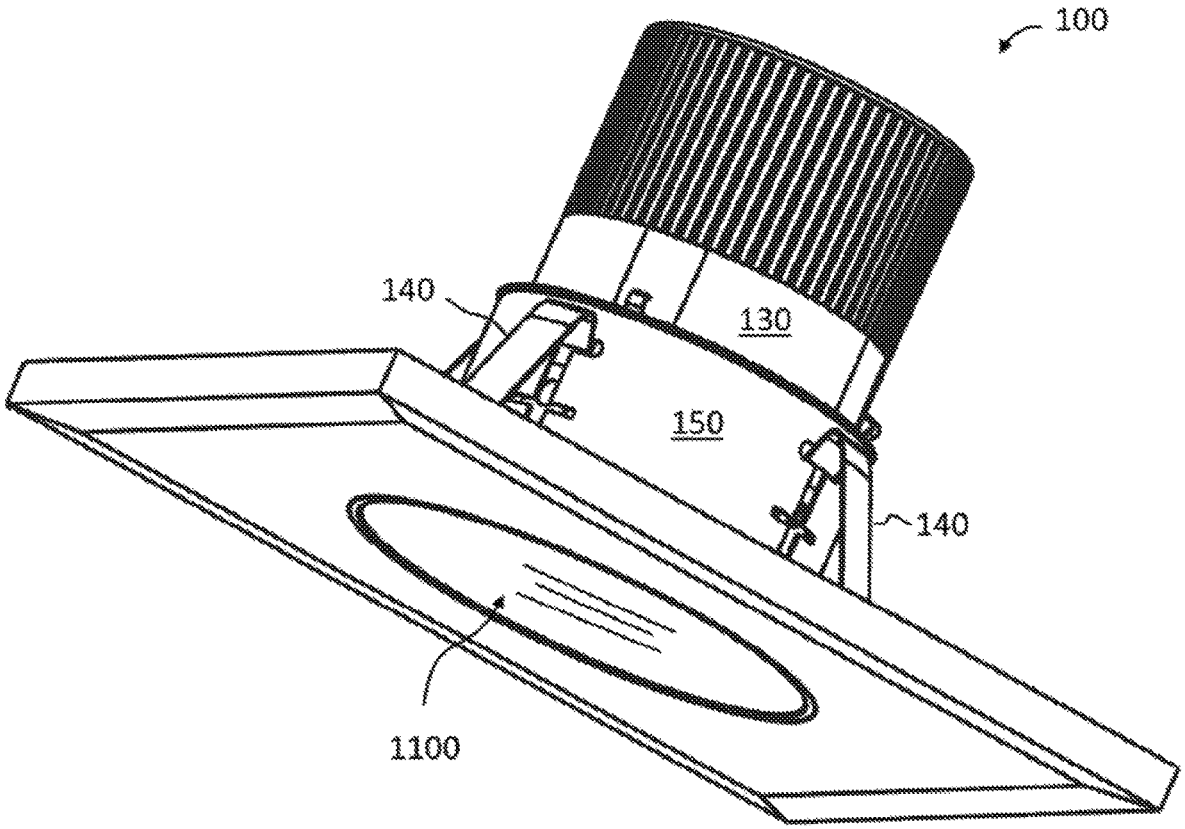
FIG. 11 is a perspective view depicting an example device mounting system employed in an embodiment where the device is a combined smoke and carbon monoxide detector.

Device internals are disposed in the device can 120. In an embodiment where the device is a speaker, such as the active speaker shown in FIGS. 1-6, a speaker cone, surround, and dust cap 159 (see FIG. 5) may be disposed on the bottom face of the device can body 150, and driven by a voice coil and speaker magnet (not shown) mounted inside the device can body 150. In an active speaker embodiment, the device internals may also include an active crossover component and amplifier assembly 175 including a power over Ethernet (POE) port 185. In other embodiments, the device internals may take other forms. Referring to FIG. 8, in an embodiment where the device is a passive speaker that lacks amplification capabilities, the device internals may include a passive speaker back assembly 177 including speaker level audio via ports 190. Referring to FIGS. **9*a*-9*c*, in an embodiment where the device is a light fixture, the device internals may include a flood light element (e.g., a light-emitting diode (LED) flood light bulb) 910, a spot light element (e.g., a LED spot light bulb) 920, or a wall washer element (e.g., a LED bulb in a directional mounting) 930. Referring to FIG. 10, in an embodiment where the device is a camera 1000, the device internals may include lenses, image sensors and supporting electronics. Referring to FIG. 11, in an embodiment where the device is a combined smoke and carbon monoxide detector 1100, the device internals may include a LED and photocell for performing optical smoke detection, an ionization chamber and electrodes for performing ionization based smoke detection, a metal oxide semiconductor or electrochemical sensor for performing carbon monoxide detection, an alarm speaker, as well as other supporting electronics and connections. It should be understood that a wide variety of other devices may alternatively make use of the device mounting system 100**, and that the device internals may take a wide number of different forms.

In a typical installation, an installer installs the device can 120 at a second time, often at a late stage of the project. In a retro-fit application, the second time may be when all cabling has been installed and the project is drawing towards completion. In a new construction application, the second time may be when construction is substantially complete, and delicate device internals are less likely to be damaged from dust, debris, impact, moisture, etc. To install the device can 120, the installer connects cabling to the device can, and then inserts the device can body 150 into the hollow cavity defined mounting ring body 130 and presses it therein. The device can 130 is retained by a combination of the magnets 160, which are attracted to the mounting ring flange 135, and spring force of the additional spring clips 165 engaging with the inner surface and top rim of the mounting ring body 130 which provides additional mounting security. In some cases, for example, where the device is an active or passive speaker, the installer may complete the installation by applying the grille or faceplate 170 to the bottom face of the device can 120, which is held in place by the magnets 160. In such a case, magnets 160 may play a duel role, serving to both help retaining the device can 120 in the mounting ring 110, and to retain the grille or faceplate 170.

Should it be required, the installer can remove the device can 120 from the mounting ring 120 by grasping and pulling upon the device can flange 155. The additional spring clips 165 may allow for smoother removal and minimize the potential of dropping the device can 120. Magnets may transition from a high force of attraction to a low force of attraction rapidly with increasing distance. Such transition may prove startling to the installer, increasing a risk of dropping the device can 120. The additional spring clips 165 may provide resistance over a longer distance, as they engage and drag against the inner walls of the mounting ring body 130, smoothing out the force required for removal.

The device mounting system 100 may provide a number of advantages over prior designs. For example, the installation of the device can 120 into the mounting ring 110, and the mounting ring 110 into the hole in the wall or ceiling surface (e.g., drywall) may be tool-less, being performed simply by a press fit. Issues of over tightening or under-tightening screws, and potential damage to a flange or the wall or ceiling surface (e.g., drywall), or lack of secure mounting, are avoided. Further, the device can 120 may be easily removable from the mounting ring 110. If repeated removals are required, they can be conducted without wear upon, and potential damage to, the wall or ceiling surface (e.g., the drywall). Still further, the device mounting system 100 may be flexibly used, permitting work to be performed at the times most convenient in new construction and retro-fit workflows, and when damage to device internals may be best avoided.

It should be understood that a device mounting system 100 may be constructed in a variety of different sizes to support different sizes and types of devices. For example, the device mounting system may be used constructed in 4 inch (in), 5 in and 6.5 in configurations, among others.

Further, it should be understood that many different adaptations and modifications may be made to the device mounting system 100. For example, while an example embodiment is discussed above in which the mounting ring 110 and device can 120 each may have a substantially cylindrical body 130, 150, it should be understood that the mounting ring 110 and device can 120 may have different cross sections (e.g., a rectangular cross section, a rounded rectangle cross section, a square cross section, an oval cross section, etc.), such that the mounting ring body 130 and the device can body 150 may substantially resemble a variety of different types of prisms. Accordingly, the terms "ring" and "can" should be interpreted broadly to encompass different cross sections, and forming types of prisms other than cylinders.

Further, while an example embodiment is discussed above in which the mounting ring flange 135 is made of a ferromagnetic metal (e.g., steel) and the grille or faceplate 170 includes ferromagnetic metal (e.g., steel) pieces, so that magnets 160 in the device can flange 155 are attracted to both of them, it should be understood that different arrangements are possible that utilize the principle of magnetic attraction in different ways. For example, magnets may be mounted in the mounting ring flange 135 and/or grille or faceplate 170 to interact with magnets 160 in the device can flange 155. Alternatively, magnets may be mounted in the mounting ring flange 135 and/or grille or faceplate 170, and no magnets mounted in the device can flange 155. In such a case, the device can flange 155 may be constructed of a ferromagnetic metal (e.g., steel) to permit attraction. A wide variety of additional configurations using one or more magnets are expressly contemplated.

Additionally, while an example embodiment is discussed above in which the device can 120 is retained in the mounting ring 110 by a combination of both magnetic attraction of magnets 160 and spring force of additional spring clips 165, it should be understood that only a single one of these modes may be used. For example, the device can 120 may be retained only with magnetic attraction of magnets 160, or the device can 120 may be retained only with spring force of additional spring clips 165.

Above all, it should be understood that the above embodiments are meant to be taken only by way of example.

What is claimed is:

1. A mounting system for mounting a device in a wall or ceiling, comprising:

a mounting ring configured to be retained in a hole in a surface of the wall or ceiling, the mounting ring including a mounting ring body having an inner surface that defines a hollow cavity, and a mounting ring flange that extends from the mounting ring body; and a device can configured to be inserted into the mounting ring, the device can including a device can body sized to fit within the hollow cavity defined by the mounting ring body, device internals configured to provide a device function, one or more first spring clips, and a device can flange that extends from the device can body and is configured to engage the mounting ring flange, wherein the device can is retained within the mounting ring by a combination of magnetic attraction between the device can flange and the mounting ring flange and spring force of the one or more first spring clips.

2. The mounting system of claim 1, wherein the one or more first spring clips are affixed to the device can body and extend from an exterior surface thereof to engage the inner surface or a top rim of the mounting ring body.

3. The mounting system of claim 1, wherein the mounting ring flange includes a ferromagnetic metal, and the mounting system further comprises:

one or more magnets disposed in the device can flange that magnetically attract the ferromagnetic metal of the mounting ring flange.

4. The mounting system of claim 1, wherein the device comprises an active or a passive speaker, and the device internals comprise at least a speaker cone and a voice coil.

5. The mounting system of claim 4, further comprising:

a grille that covers at least a portion of the device can, wherein the grille includes one or more pieces of ferromagnetic metal that are magnetically attracted to the one or more magnets in the device can flange, and wherein the one or more magnets disposed in the device can flange both serve to retain the device can within the mounting ring and retain the grille to the device can.

6. The mounting system of claim 1, wherein the device comprises at least one of a light fixture, a camera, a smoke detector or a carbon monoxide detector.

7. The mounting system of claim 1, wherein the mounting ring is configured to be retained directly in a hole in the wall or ceiling surface.

8. The mounting system of claim 7, wherein the mounting ring flange is configured to engage an exterior face of the wall or ceiling surface, and the mounting system further comprises one or more second spring clips affixed to the mounting ring body and that extend from an exterior surface thereof to engage an interior face of the wall or ceiling surface, wherein the mounting ring is configured to be retained in the hole in the wall or ceiling surface by pinching action caused by the one or more second spring clips.

9. The mounting system of claim 1, further comprising:

a pre-construction bracket disposed in the wall or ceiling, wherein the mounting ring is configured to be retained within the pre-construction bracket.

10. The mounting system of claim 9, further comprising:

one or more second spring clips affixed to the mounting ring body and that extend from an exterior surface therefrom to engage at least in part the pre-construction bracket, wherein the mounting ring is configured to be retained in the pre-construction bracket in in the wall or ceiling by pinching action caused by the one or more second spring clips.

11. The mounting system of claim 1, wherein the mounting ring body and the device can body are both substantially cylindrical and the mounting ring flange extends radially at an end of the mounting ring body, and the device can flange extends radially from an end of the device can body.

12. A device mounting system for mounting a device in a wall or ceiling, comprising:

a mounting ring configured to be retained in a hole in a surface of the wall or ceiling, the mounting ring having a mounting ring flange;

a device can that holds device internals configured to provide a device function, the device can configured to be inserted into the mounting ring, the device can including a device can flange configured to engage the mounting ring flange;

one or more magnets disposed in the device can flange, and one or more first spring clips, wherein the device can is retained within the mounting ring by a combination of magnetic attraction between the device can flange and the mounting ring flange produced by the one or more magnets and spring force produced by the one or more first spring clips.

13. The mounting system of claim 12, wherein the device comprises a passive or an active speaker, and the device internals comprise at least a speaker cone and a voice coil.

14. The mounting system of claim 13, further comprising:

a grille that covers at least a portion of the device can, wherein the one or more magnets both serve to retain the device can within the mounting ring and to retain the grille to the device can.

15. The mounting system of claim 12, wherein the device comprises at least one of a light fixture a camera, a smoke detector or a carbon monoxide detector.

16. The mounting system of claim 12, wherein the mounting ring is configured to be retained directly in a hole in the wall or ceiling surface.

17. The mounting system of claim 12, wherein the mounting ring is configured to be retained within a pre-construction bracket that disposed in the wall or ceiling.

18. The mounting system of claim 12, wherein the mounting ring and the device can are both substantially cylindrical.

* * * * *